United States Patent [19]

Kimura et al.

[11] 4,342,662

[45] Aug. 3, 1982

[54] GETTER DEVICE

[75] Inventors: Sakae Kimura, Tokyo; Masahiro Shimura, Yokohama; Tadatake Okai, Kawasaki, all of Japan

[73] Assignee: Tokyo Shibaura Denki Kabushiki Kaisha, Kawasaki, Japan

[21] Appl. No.: 201,198

[22] Filed: Oct. 27, 1980

[30] Foreign Application Priority Data

Oct. 25, 1979 [JP] Japan ..... 54-137001
May 21, 1980 [JP] Japan ..... 55-66424

[51] Int. Cl.[3] ..... H01J 7/18

[52] U.S. Cl. ..... 252/181.4; 252/181.7; 313/480; 313/481; 313/178; 316/3; 316/25

[58] Field of Search ..... 252/181.4, 181.7; 427/248 H, 387, 64, 67, 123, 126; 428/447; 417/48–51; 313/479–481, 178; 316/3, 24, 25

[56] References Cited

U.S. PATENT DOCUMENTS 3,973,816 8/1976 Van Bakel et al. ..... 252/181.4 X
3,977,813 8/1976 Bustard et al. ..... 252/181.4
4,045,367 8/1977 Van Bakel et al. ..... 252/181.4
4,077,899 3/1978 van Gils ..... 252/181.4
4,127,361 11/1978 Hellier et al. ..... 252/181.4 X

FOREIGN PATENT DOCUMENTS 52-139355 11/1977 Japan ..... 252/181.4

OTHER PUBLICATIONS

*J. Am. Ceramic Society*, 48, [2] 78, (1965), T. J. Rockett, W. R. Foster.

*Primary Examiner*—Joseph L. Schofer
*Assistant Examiner*—J. L. Barr
*Attorney, Agent, or Firm*—Cushman, Darby & Cushman

[57] ABSTRACT

A getter device is disclosed in which at least on the exposed surface of a getter material filled in a metal getter container and containing a barium-aluminum alloy powder and a nickel powder is formed a gas-impermeable film of a boron compound or a mixture of a boron compound with silicon oxide.

4 Claims, 2 Drawing Figures

GETTER DEVICE

BACKGROUND OF THE INVENTION

The present invention relates to a getter device in which a getter material containing a barium-aluminum alloy powder and a nickel powder is filled in an open annular metal getter container for evaporation of barium upon heating.

A getter device, in an evacuated and sealed envelope, is generally heated by methods such as high frequency induction heating to form a getter film of barium on the inner wall of the evacuated envelope. Before such a procedure, the getter device may be exposed to heat which is undesirable. This applies, for example, to the manufacturing process of a picture tube as disclosed in the specification of Japanese Patent Publication No. 49-12,031. According to this specification, a getter device is mounted inside a picture tube composed of a panel part and a funnel part which are not yet sealed with frit glass. After heating at about 400°–450° C. for 1 hour in air, the panel part and the funnel part are sealed with frit glass.

A general getter material containing a mixed powder of $BaAl_4$ powder and Ni powder (weight mixing ratio: about 1:1) generates mainly nickel oxide (NiO) by oxidation when heated at over about 350° C. in air for a long period of time. When NiO is present in the getter device, NiO and $BaAl_4$ react rapidly at high temperatures. When evaporating barium by heating the getter device (to be referred to as a getter flash hereinafter for brevity), this results in an explosive release of barium. When NiO is produced in large amounts, the metal container melts and explosively scatters with the getter material. This kind of explosive scattering must be completely avoided in, for example, a color cathode ray tube since it tends to cause degradation in withstanding voltage. Due to this, a getter device which will not cause problems at high temperatures in air has been desired.

In order to accomplish this, a getter device coated with an organic silane is disclosed in Japanese Patent Disclosure No. 52-84,960, and a getter device coated with silicon oxide is disclosed in Japanese Patent Disclosure No. 52-139,355.

Japanese Patent Disclosure No. 52-84,960 teaches that a getter device coated with an organic silane such as polysiloxane containing alkyl, allyl, aralkyl, alkalyl or hydrogen is capable of withstanding heating at 420° C. for one hour for evaporation of barium, without causing explosive scattering.

However, a getter device coated with such an organic silane presents the defects to be described below during use. A getter device of this type mainly produces a great amount of hydrocarbon-based gas during the getter flash. The produced gas is not easily adsorbed in the getter film, so that the pressure inside the tube is left at about $10^{-3}$ Torr after the getter flash.

As is well known, such a great amount of residual gas is ionized, accelerates and collides with the cathode or the anode applied with a high voltage such as in a cathode ray tube. It is well conceivable that, due to this so-called sputtering effect, part of the electron emissive material on the cathode scatters to other places, significantly degrading the withstanding voltage.

Japanese Patent Disclosure No. 52-139,355 teaches that a getter device coated with a silicon oxide film is capable of withstanding heating at 450° C. for one hour in air, and that such a silicon oxide film is obtainable by immersing the getter device in an ethyl silicate solution prepared by hydrolysis of a composition consisting of, for example, methanol, deionized water and nitric acid, and heating the remaining silicate at 120° C. in a vacuum. Such a getter device shows significant resistance to oxidation at high temperatures. When a getter device which does not have such a protective film is heated at 450° C. for one hour in air and undergoes a getter flash in a vacuum, explosive scattering occurs. However, with a getter device whose surface is coated with a silicon oxide film as described above, when it is heated in air and undergoes a getter flash in a vacuum, the degree of the explosive scattering becomes slight, and only a small amount of the sintered getter material is removed or peeled off to the outside of the chamber. However, even slight explosive scattering and peel-off of the getter material should be avoided completely in an electron tube such as a cathode ray tube, because those phenomena significantly degrade the withstanding voltage of the electron tube. The explosive scattering tends to cause adherance of the scattered particles at undesirable places of the tube, resulting in degradation of the withstanding voltage and frequently resulting in short-circuiting. The peel-off of the getter material tends to cause formation of a barium film at undesirable places of the tube, and this results in degradation of the withstanding voltage. One of the possible reasons for the explosive scattering is the oxidation of nickel in the getter material, although this may only result in a slight amount of explosive scattering. The surface of the getter device coated with a silicon oxide film as described hereinbefore was observed with an electron microscope and it was found that the silicon oxide film consisted of a porous structure. It is thus considered that oxygen is supplied to the getter device through these small holes and part of the getter material is oxidized.

SUMMARY OF THE INVENTION

It is, therefore, the primary object of the present invention to provide a getter device which has resistance to oxidation at high temperatures, which is capable of preventing explosive scattering of the getter material during a getter flash in a vacuum and evolution of hydrocarbon-based gas, and which does not adversely affect other components of the device such as an electron tube.

In order to achieve this object, there is provided according to the present invention a getter device which is characterized by comprising a metal getter container, a getter material filled in said getter container comprising a barium-aluminum alloy and a nickel powder, and a gas-impermeable film covering the exposed surface of the getter material and comprising at least one boron compound selected from the group consisting of boric anhydride, orthoboric acid, metaboric acid, and tetraboric acid.

There is provided according to another aspect of the present invention a getter device which is characterized in that said gas-impermeable film further contains less than 5% by weight of silicon oxide.

DETAILED DESCRIPTION OF THE INVENTION

Figure 1:
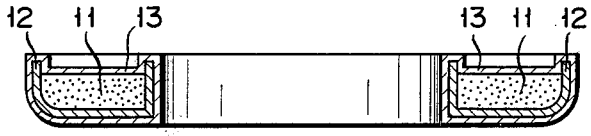
FIG. 1 is a transverse sectional view of a getter device according to the present invention.

As has been described hereinbefore, a getter device mounted inside a picture tube is exposed to heating at about 400°–450° C. in air when sealing the panel part and the funnel part of the picture tube with frit glass. Thus, the getter device must be coated with a fine gas-impermeable film which is stable at temperatures of about 450° C. and which is dense and has good adhesion. The getter device of the present invention is made to satisfy these requirements by forming, on at least an exposed surface of the getter material of the getter device, a film consisting of a boron compound or a boron compound containing a small amount of silicon oxide.

The addition of silicon oxide has the effect of improving the water resistance of the film on the exposed surface of the getter material. When the getter device mounted in the picture tube is left in a highly humid atmosphere for a long period of time, the water content in the atmosphere is adsorbed in the film of the boron compound. The adsorbed water is partially exhausted outside the tube in the following evacuation step, and the rest is evolved inside the tube during the getter flash step. The evolved water, as is well known, reacts with the carbon compound adsorbed in the barium film and is converted into a hydrocarbon-based gas such as methane. This gas is not easily adsorbed in the getter film and thus remains in the tube for a considerable period of time after the getter flash.

However, it has been found that when a film is formed of a boron compound with silicon oxide, adsorption of water as described above may be substantially prevented.

According to the present invention, the film of the boron compound may be formed on the surface of the getter device in the manner to be described below. The getter device is first immersed in an alcohol solution of a boron compound. After drying, the getter device is heated in a vacuum for degassing. During this step, the boron compound melts and the surface of the getter device is coated with a glassy boron compound which is transparent and dense. The boron compound in the present invention is one member selected from the group consisting of boric anhydride, orthoboric acid, metaboric acid, and tetraboric acid; or a mixture thereof. Substantially the same effects may be obtained with any of these substances. That is, the getter device is not substantially oxidized upon heating at 450° C. for 2 hours. Formation of NiO which results in the explosive scattering is not substantially noted. The getter device heated at 450° C. for 2 hours in air may be readily used without showing any defects in its characteristics.

A case when a mixture of a boron compound and silicon oxide is used will be described.

It is known that a mixture of silicon dioxide ($SiO_2$) and boric anhydride ($B_2O_3$) becomes glassy upon heating when the content of $SiO_2$ is less than 5% by weight as described in T. J. Rocket, W. R. Foster: J. Am. Ceram. Soc., 48 [2] 78 (1965). With a $B_2O_3$-$SiO_2$ mixture, the eutectic point is at 2% by weight of $SiO_2$ and the melting point is lowered.

When a mixture of a boron compound and $SiO_2$ is applied to at least the exposed surface of the getter material and a fine gas-impermeable film is thereafter formed by heating and melting in a vacuum, the vacuum treating temperature is mainly limited by the sintering of the nickel powder in the getter material.

The nickel powder of several μm particle size used in the getter device becomes larger in particle size by sintering at about 600° C. This decreases the reaction rate of Ni with $BaAl_4$ during the getter flash and consequently reduces the amount of the evaporated barium. Thus, the vacuum treating temperature should be less than 550° C. and preferably less than 500° C.

The $B_2O_3$-$SiO_2$ mixture has a melting point of less than 500° C. when the $SiO_2$ content is less than about 7%. However, considering the treating time, the practical content of $SiO_2$ is less than 5%.

The getter device of the present invention will now be described with reference to the accompanying drawings. FIG. 1 is a transverse sectional view of a getter device of the present invention wherein a getter material 11 containing a barium-aluminum alloy powder and a nickel powder is filled in an annular metal getter container 12 which has substantially U-shaped cross section. The surfaces of the getter container 12 and the getter material 11 are completely coated with a film of a boron compound 13 which may or may not contain silicon oxide.

The getter device of the present invention will now be described by way of examples.

EXAMPLE 1

An exothermic barium getter device having a nitrogen emitting source was used which had an annular metal getter container of stainless steel, a U-shaped cross sectional area, and dimensions of 22 mm outer diameter, 15 mm inner diameter and 1.9 mm height. In it was filled a getter material consisting of a mixed powder of $BaAl_4$ powder and Ni powder (about 1:1 weight mixing ratio) and several % of germanium nitride-iron powder. This getter device was immersed in a methanol solution containing 10% by weight of boric anhydride. After drying with an infrared ray lamp, the getter device was heated at 500° C. for 30 minutes in a vacuum to provide a getter device as shown in FIG. 1. The surface of the getter device was coated with a thin, transparent and fine boron compound of about 1 μm thickness.

After heating the getter device at 450° C. for 2 hours in air, the getter device was placed in an evacuated envelope and was induction-heated from outside with a high frequency means for effecting to flash a getter. The residual gas in the evacuated envelope was analyzed with a residual gas analyzer. Hydrocarbon-based gases were found to be present in very small amounts. After flash experiments using many getter devices, explosive barium scattering and the phenomenon of peel-off were not observed. The distribution of the formed barium film, the amount of the flashed barium, and the amount of the outgassing were measured, and no defect was observed.

EXAMPLE 2

An exothermic barium getter device filled with a getter material as in Example 1 was immersed in a methanol solution containing 10% by weight of boric anhydride in which was dispersed a silicon dioxide powder. The silicon dioxide powder used had a particle size of 0.1 μm for melting it easily, and the added amount was 2% by weight based on the content of the boric anhydride. After the immersion, the getter device was dried with an infrared ray lamp and heated at 500°0 C. for 30 minutes in air to provide a getter device as shown in FIG. 1. The surfaces of the getter container and the getter material were coated with a thin, transparent and fine boron compound-silicon dioxide film.

After heating the resultant getter device at 450° C. for 2 hours in air, it was placed in an evacuated envelope and induction-heated from the outside with a high frequency means for effecting to flash a getter. The residual gas in the evacuated envelope was analyzed with a residual gas analyzer. Hydrocarbon-based gases were found to be present in very small amounts. Similar tests were conducted after heating the getter device at 450° C. for 2 hours and leaving it to stand in a room at 70% humidity for 24 hours. The increase in the amount of hydrocarbon-based gases was small. Flashing tests were also conducted using many getter devices, and no explosive barium scattering or peel-off phenomenon were observed at all. The amount and distribution of the flashed barium, and the amount of the outgassing were measured, and no defect was noted.

EXAMPLE 3

Figure 2:
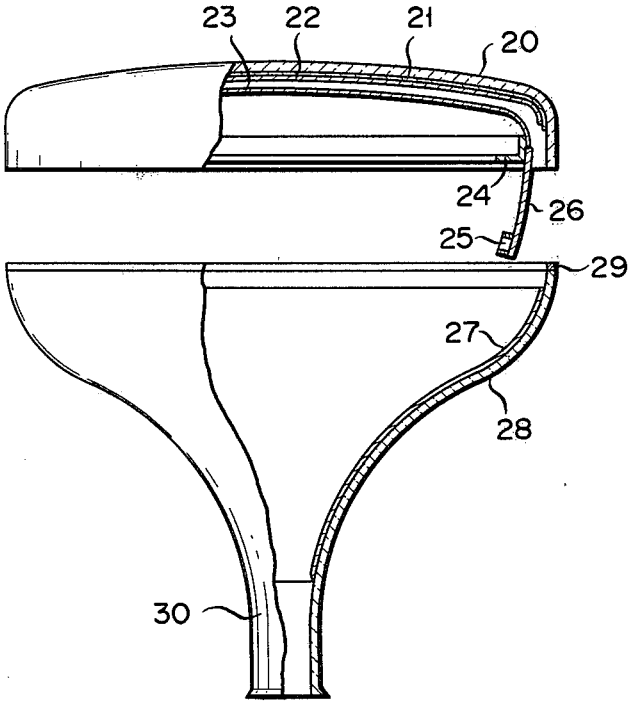
FIG. 2 is a partial sectional view of a getter device of the present invention as applied to a cathode ray tube.

This example is the case where the getter device of the present invention was applied to a cathode ray tube as shown in FIG. 2. Referring to FIG. 2, a phosphor layer 21 and an aluminum evaporated film 22 were formed on a front surface glass panel 20, and a shadow mask 23 was attached through a frame 24. A getter device 25 as obtained in the manner explained in Example 1 was mounted on the frame 24 through a support plate 26. Thereafter, the glass panel 20 and a funnel 28 coated inside with aquadag 27 in a usual manner were sealed with frit glass 29. They were securely fixed by heating at about 450° C. for one hour, and the organic material (not shown) between the phosphor layer and the metal back film was evaporated. Then, an electron gun was mounted to a neck part 30 and sealed after evacuation in a known manner. A getter flash was effected by induction heating with a high frequency means, and a cathode ray tube was produced after the aging of the electron gun and so on. The electron emitting characteristics of the cathode ray tube thus obtained were confirmed to be normal.

EXAMPLE 4

The procedure was the same as in Example 3 except that the getter device as fabricated in Example 2 was used. The glass panel 20 and the funnel 28 with the aquadag 27 coated inside were sealed with the frit glass 29. They were securely fixed by heating at about 450° C. for one hour, and the organic material (not shown) between the phosphor layer and the metal back film was evaporated. After leaving the device to stand in a room at 75% humidity for 24 hours, an electron gun was mounted to the neck part 30 and was sealed after a step of evacuation in a known manner. After the aging of the electron gun and so on, a cathode ray tube was produced. It was confirmed that cathode ray tube thus obtained presented no defect in the electron emitting characteristics.

Boric anhydride is mainly converted into orthoboric acid after being dissolved in an alcohol solution and dried in air. Orthoboric acid is converted into metaboric acid, tetraboric acid and boric anhydride depending on the heating conditions. Getter devices were fabricated in the same manner as in Example 1 and 2 using one or more of these boron compounds, and getter flashes were effected. The same effects were obtained as in Examples 1 and 2.

With the getter device of the present invention, the getter device need not be inserted through the neck part 30 of the funnel 28 so that the diameter of the neck part 30 may be made smaller. This is quite advantageous for making a compact cathode ray tube designed for energy saving. Furthermore, since it is possible to electrically separate the getter device from the electron gun, undesirable flow of a surge current through the getter device and the electron gun may be prevented.

In summary, with the getter device of the present invention, the resistance of the device to oxidation at high temperatures is improved by coating the getter opening with a boron compound. Furthermore, by using a boron compound with silicon dioxide ($SiO_2$) added to coat the getter device opening, a getter device is obtained with such practical advantages as improved water resistance and not adversely affecting other components.

What we claim is:

1. A getter device comprising a metal getter container, a getter material filled in said getter container comprising a barium-aluminum alloy and a nickel powder, and a gas-impermeable film covering at least the exposed surface of the getter material and comprising at least one boron compound selected from the group consisting of boric anhydride, orthoboric acid, metaboric acid, and tetraboric acid.

2. A getter device according to claim 1 wherein the gas-impermeable film contains less than 5% by weight of silicon oxide.

3. A getter device according to claim 1 or 2 wherein the gas-impermeable film is glassy.

4. A getter device according to claim 1 or 2 wherein the gas-impermeable film is coated over the entire surface of the getter container.

* * * * *